US012024765B2

(12) United States Patent
Ledoux et al.

(10) Patent No.: US 12,024,765 B2
(45) Date of Patent: Jul. 2, 2024

(54) AlMgMn ALLOY PRODUCT WITH IMPROVED CORROSION RESISTANCE

(71) Applicants: CONSTELLIUM ISSOIRE, Issoire (FR); CONSTELLIUM ROLLED PRODUCTS RAVENSWOOD, LLC, Ravenswood, WV (US)

(72) Inventors: Marine Ledoux, Grenoble (FR); Maria Belen Davo Gutierrez, Coublevie (ES); Timothy Warner, Corenc (FR)

(73) Assignee: CONSTELLIUM ISSOIRE (FR)

( * ) Notice: Subject to any disclaimer, the term of this patent is extended or adjusted under 35 U.S.C. 154(b) by 520 days.

(21) Appl. No.: 17/275,669

(22) PCT Filed: Sep. 9, 2019

(86) PCT No.: PCT/FR2019/052061
§ 371 (c)(1),
(2) Date: Mar. 11, 2021

(87) PCT Pub. No.: WO2020/053507
PCT Pub. Date: Mar. 19, 2020

(65) Prior Publication Data

US 2022/0049335 A1 Feb. 17, 2022

(30) Foreign Application Priority Data

Sep. 13, 2018 (FR) ..... 1858257

(51) Int. Cl.
*B32B 15/01* (2006.01)
*C22C 21/08* (2006.01)
*C22F 1/047* (2006.01)

(52) U.S. Cl.
CPC ..... *C22F 1/047* (2013.01); *C22C 21/08* (2013.01)

(58) Field of Classification Search
None
See application file for complete search history.

(56) References Cited

U.S. PATENT DOCUMENTS 11,193,193 B2 * 12/2021 Bach ..... C22C 21/08
2011/0017055 A1 1/2011 Mooy et al.
2018/0112297 A1 4/2018 Engler et al.

FOREIGN PATENT DOCUMENTS

CN 104152759 A 11/2014
CN 104404411 A 3/2015
(Continued)

OTHER PUBLICATIONS

International Search Report of International Patent Application No. PCT/FR2019/052061 dated Nov. 14, 2019.
(Continued)

*Primary Examiner* — Daniel J. Schleis
(74) *Attorney, Agent, or Firm* — McBee Moore & Vanik, IP LLC

(57) ABSTRACT

The invention relates to a method for manufacturing an aluminum alloy sheet, wherein an aluminum alloy is prepared with the following composition, in wt %: Mg: 4.0-5.2, Mn: 0.40-1.0, Zn: 0.15-0.40, at least one element selected from Ti, Cr, Cu and Zr, the content of the element, if selected, being 0.01-0.15 for Ti, 0.05-0.25 for Cr, 0.02-0.25 for Cu, 0.05-0.25 for Zr, Fe: <0.40, Si: <0.40, other elements or impurities <0.05 each and <0.15 in total, the remainder being aluminum. A rolling plate is cast by vertical semi-continuous casting, and said optionally homogenised plate is hot-rolled in two successive stages to obtain a sheet. The sheets obtained by the method according to the invention are advantageous, in particular for shipbuilding, since they demonstrate, after being exposed for 7 days to a temperature
(Continued)

of 100° C., a weight loss of less than 15 mg/cm2 during a corrosion test according to the ASTM G67 standard.

20 Claims, 1 Drawing Sheet

(56) References Cited

FOREIGN PATENT DOCUMENTS

| | | | |
|---|---|---|---|
| CN | 106244872 | A | 12/2016 |
| EP | 0804626 | B1 | 7/2001 |
| FR | 2731019 | A1 | 8/1996 |
| FR | 2740144 | A1 | 4/1997 |
| JP | S5758903 | A | 4/1982 |
| JP | S6475104 | A | 3/1989 |
| WO | 2018104004 | A1 | 6/2018 |

OTHER PUBLICATIONS

French Search Report of French Patent Application No. 1858257 dated Apr. 11, 2019.

* cited by examiner

Figure 1
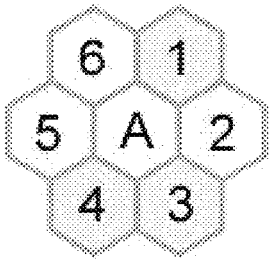
$$\Delta g_K = \frac{1}{6}(\Delta g_{A1} + \Delta g_{A2} + \Delta g_{A3} + \Delta g_{A3} + \Delta g_{A4} + \Delta g_{A5} + \Delta g_{A6})$$
FIG 1A
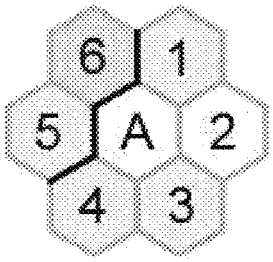
$$\Delta g_K = \frac{1}{4}(\Delta g_{A1} + \Delta g_{A2} + \Delta g_{A3} + \Delta g_{A3} + \Delta g_{A4})$$
FIG 1B
Figure 2
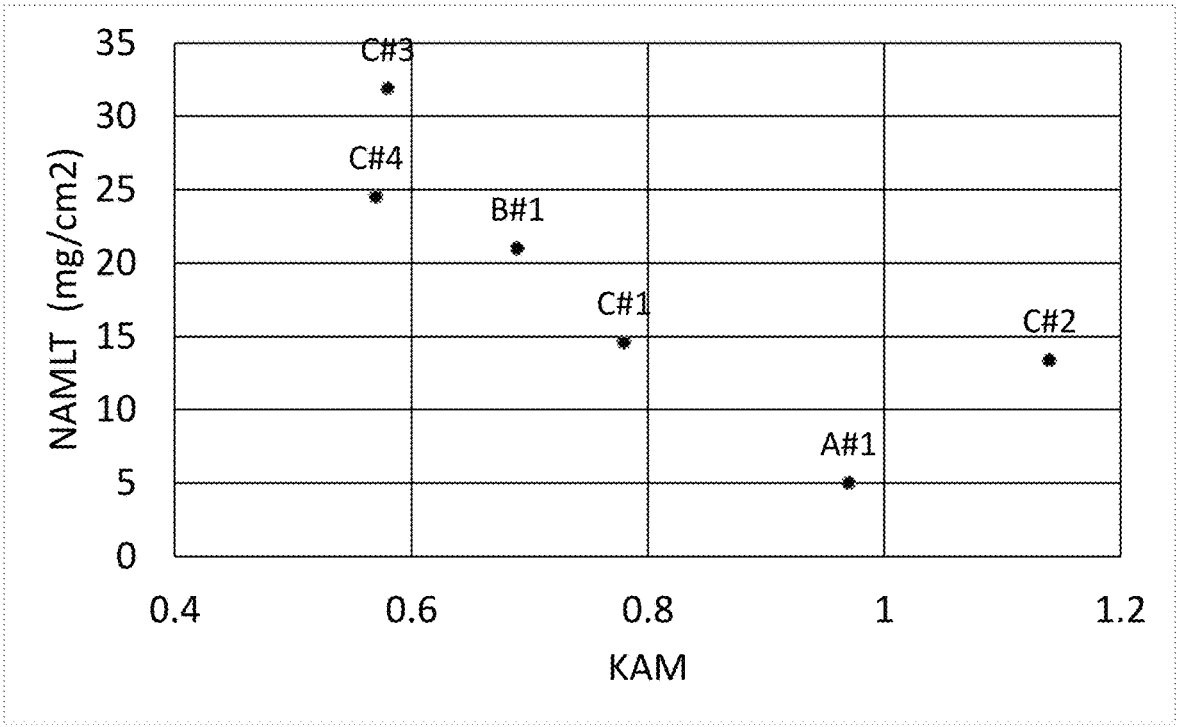

AlMgMn ALLOY PRODUCT WITH IMPROVED CORROSION RESISTANCE

CROSS-REFERENCE TO RELATED APPLICATIONS

This application is the National Stage entry of International Application No. PCT/FR2019/052061, filed 9 Sep. 2019, which claims priority to French Patent Application No. 1858257, filed 13 Sep. 2018.

BACKGROUND

Field

The invention relates to the field of rolled products such as sheets or strips of AlMgMn aluminum alloy, the Mg content of which is at least 4% by weight, having high mechanical strength, advantageous welding properties and good corrosion resistance for structural applications, such as for example boats, offshore installations or industrial vehicles.

Description of Related Art

It is well known that the use of AlMg alloys in the 5000 series in accordance with the Aluminum Association nomenclature in the hardened temper (temper H according to NF EN 515), either completely worked (temper H1), or partially softened (temper H2) or stabilized (temper H3), makes it possible to obtain good mechanical characteristics and good corrosion resistance. By way of example, the 5083, 5059, 5383 and 5086 alloys are widely used in the field of mechanical construction, welded or not, for applications that require correct corrosion resistance such as naval construction.

However, the requirements in terms of corrosion are more and more important and it is necessary for the products to remain resistant to exfoliating corrosion and intergranular corrosion even after long-term exposure, that is to say use in service including for applications in hot climates. Thus corrosion tests are performed after exposure of 7 days at 100° C. in order to simulate long-term exposure at ambient temperature. Under these conditions, intergranular corrosion due to the dissolution of the passivation layer of the β phase ($Al_3Mg_2$) that segregates at the grain boundaries has a tendency to occur.

ASTM B928 requires the NAMLT test (ASTM G67—Loss of Mass after Exposure to Nitric Acid) in order to characterize the intergranular corrosion resistance. This standard, in paragraph 10, specifies the intergranular corrosion resistance after a post-production heat treatment of 7 days at 100° C. for the H128 temper. The resistance and the resistance after welding must not be reduced.

The French patent application 1-R2731019 relates to a particular alloy composition, registered subsequently at the Aluminum Association under the designation 5383, containing among other things 3 to 5% magnesium and 0.5 to 1% manganese, wherein the sum of the contents (as % by weight) Mn+2Zn is >0.75. This composition makes it possible to obtain rolled or extruded products having significantly better fatigue strength and a significantly lower crack propagation rate than the known products intended for the same application. However, the patent application cited does not give any indication as to the corrosion resistance of the product.

The French patent application FR2740144 claims a very narrow composition, within the composition ranges of the 5083 and 5086 alloys, containing among other things 4.3 to 4.8% magnesium and less than 0.5% manganese, making it possible to obtain good characteristics during large deformations. This application also does not mention corrosion resistance.

The patent application US2011017055 relates to 5xxx aluminum alloys and products manufactured therefrom are described. The alloys described consist essentially of: 2.5% by weight % to 7% by weight Mg; 0.05% by weight % to 2% by weight Cu; 0.3% by weight % to 1.5% by weight Mn, optionally up to 2.0% by weight Zn; optionally up to 1% by weight % total additives, wherein the additives are selected from the group consisting of Zr, Cr, V, Sc, Hf, Ti, B, C, Ca, Sr, Be, Bi, Cd, Ge, In, Mo, Nb, Ni, Sn, Y; and the rest being aluminum and unavoidable impurities. The novel products made from 5xxx aluminum alloy can afford an improved combination of properties by virtue, for example, of the presence of copper. In one embodiment, the novel products made from 5xxx aluminum alloy are capable of obtaining an improved combination of properties by solution heat treatment.

The patent application CN104404411 relates to a method for producing aluminum alloy sheets that comprises the following steps: initially, carrying out a homogenization heat treatment on an aluminum alloy ingot, wherein the proportion by mass of magnesium in the aluminum alloy ingot is 4.0%-4.9%, performing a primary deformation by hot rolling in order to obtain an intermediate aluminum alloy plate; finally, carrying out a secondary hot rolling on the intermediate aluminum alloy plate in order to obtain an aluminum alloy plate. The method for producing aluminum alloy sheets is particularly appropriate for producing marine aluminum alloy plates, and relates in particular to the H116 temper of a 5083 aluminum alloy. The aluminum alloy plate produced by the method for producing aluminum alloy sheets has high corrosion resistance and mechanical properties.

The patent application CN104152759 relates to Al—Mg alloys with high strength and resistance to alloy corrosion and a technology for preparation thereof. The components of the alloy are as follows as a percentage by mass: 5.0 to 6.5% Mg, 1.2 to 2.5% Zn, 0 to 0.4% Cu, 0.4 to 1.2% Mn, 0 to 0.1% Cr, 0 to 0.15% Ti, 0.05 to 0.25% Zr, 0 to 0.4% Fe, 0 to 0.4% Si and the rest Al and unavoidable impurities. The manufacturing method includes the steps of casting, homogenization, hot rolling, recrystallization annealing, cold rolling, stabilization treatment and pre-drawing.

The patent application CN106244872 relates to a preparation method for a panel of average thickness made from Al—Mg aluminum alloy having high corrosion resistance for marine applications. The preparation method comprises the steps of homogenization, annealing heat treatment, hot rolling, cold rolling and heat treatment stabilization heat treatment.

The patent application WO2018104004 relates to a method for manufacturing a product made from wear-resistant rolled aluminum alloy comprising the steps consisting of: providing an aluminum alloy slab having Mg at 4.20% to 5.5%, Mn at 0.50% to 1.1% up to 0.40%, Si up to 0.30%, Cu up to 0.20%, Cr up to 0.25%, Zr up to 0.25%, Zn up to 0.30%, Ti up to 0.25%, hot rolling to an intermediate thickness of 15 mm to 40 mm and then hot rolling to a final thickness of 3 mm to 15 mm and wherein the exit temperature of the hot mill is between 130° and 285° C., and then cooling to ambient temperature. This application also does not mention corrosion behavior.

The problem to which the present invention attempts to respond is therefore proposing AlMgMn alloy rolled products having, after long-term exposure, improved corrosion behavior while keeping good mechanical characteristics before and after welding, having good fatigue behavior and being able to be produced at less cost.

SUMMARY

The applicant has found that some AlMgMn alloys can be made more resistant to the sensitizing effect of a long-term exposure when they are obtained by a specific manufacturing method. The applicant has in particular found that, in a specific range of Mg, Mn and Zn content, these alloys have a particular and well-defined microstructure, which results from a set of parameters of the manufacturing method.

A first object of the invention is a method for manufacturing such an aluminum alloy sheet, wherein a) an aluminum alloy is prepared, with the composition, as % by weight
   Mg: 4.0-5.2,
   Mn: 0.40-1.0,
   Zn: 0.15-0.40,
   at least one element selected from Ti, Cr, Cu and Zr, with a content, if it is selected, of 0.01-0.15 for Ti, 0.05-0.25 for Cr, 0.02-0.25 for Cu, 0.05-0.25 for Zr,
   Fe: <0.40,
   Si: <0.40,
   other elements or impurities <0.05 each and <0.15 in total, the remainder aluminum,
b) a slab is cast by vertical semicontinuous casting,
c) optionally, said slab is homogenized,
d) said optionally homogenized slab is hot rolled, in two successive steps, in order to obtain a sheet
   d1) a hot-rolling step on a reversible mill to a thickness of between 12 and 35 mm,
   d2) a hot-rolling step on a tandem mill to a thickness of between 3 and 12 mm, wherein the final temperature is at least 240° C. and is less than 300° C.,
e) optionally, said sheet is cold rolled, to a thickness of between 1 and 4 mm,
f) optionally, a final heat treatment of said optionally cold-rolled sheet is carried out at a temperature below 300° C.

A second object of the invention is an aluminum alloy sheet with a thickness of between 1 and 12 mm with the composition, as % by weight, Mg: 4.0-5.2,
Mn: 0.40-1.0,
Zn: 0.15-0.40,
at least one element selected from Ti, Cr, Cu and Zr, with a content, if it is selected, of 0.01-0.15 for Ti, 0.05-0.25 for Cr, 0.02-0.25 for Cu, 0.05-0.25 for Zr,
Fe: <0.40,
Si: <0.40,
other elements or impurities <0.05 each and <0.15 in total, the remainder aluminum,
able to be obtained by the method according to the invention having, after exposure of 7 days at 100° C., a weight loss of less than 15 mg/cm$^2$ during a corrosion test in accordance with ASTM G67.

Yet another object of the invention is the use of a sheet of the invention in naval construction or for the construction of industrial vehicles.

BRIEF DESCRIPTION OF THE DRAWINGS

FIGS. 1A and 1B describe the analysis of the misorientations in the granular regions for the KAM measurement.

FIG. 2 illustrates the relationship between KAM measurement and corrosion result in the NAMLT test after exposure of 7 days at 100° C.

DETAILED DESCRIPTION OF A PREFERRED EMBODIMENT

Unless mentioned to the contrary, all the indications relating to the chemical composition of the alloys are expressed as a percentage by weight based on the total weight of the alloy. The expression 1.4 Cu means that the copper content expressed as % by weight is multiplied by 1.4. The alloys are designated in compliance with the regulations of the Aluminum Association, known to persons skilled in the art.

The definitions of the metallurgical tempers are indicated in the European standard EN 515. The tensile static mechanical characteristics, in other words the ultimate tensile strength Rm, the conventional yield strength at 0.2% elongation Rpo 2, and the elongation at rupture A %, are determined by a tensile test in accordance with NF EN ISO 6892-1/ASTM E8-E8M-13, the sampling and the direction of the test being defined by EN 485-1.

Unless mentioned to the contrary, the definitions in EN 12258 (2012) apply.

The corrosion tests are performed in accordance with ASTM B928/B928M and ASTM G66/G67.

The applicant has found surprisingly that a specific composition of Al—Mg alloys combined with a specific rolling method makes it possible to obtain the required corrosion properties. The method according to the invention comprises the steps of preparing an alloy according to the invention cast, optionally homogenization, hot rolling in two steps, optionally cold rolling, and optionally final heat treatment.

The composition limits adopted are explained as follows:

The addition of magnesium makes it possible to ensure good mechanical strength. Below 4.0% by weight, the mechanical strength is insufficient. In addition, below 4.0% by weight the alloy does not in general experience any corrosion problem and the present invention has only little interest. Above 5.2% by weight, the problem of thermal sensitization to corrosion becomes so strong that even the implementation of the present invention no longer makes it possible to obtain products that can be used in a corrosive environment. In a first embodiment, the magnesium content is between 4.0 and 4.6% by weight and preferably between 4.1 and 4.5%, the products obtained being particularly resistant to corrosion. In a second embodiment the magnesium content is between 4.7 and 5.2% by weight and preferably between 4.7 and 5.0% by weight, the products obtained having in particular high mechanical strength after welding.

Manganese improves tensile strength and reduces the tendency of the metal to recrystallize. Below 0.40% by weight manganese, the present invention has no industrial interest since the tensile strength is too low. Beyond 1%, the elongation at rupture, the toughness and the fatigue strength become too low for the applications sought. In the first embodiment having a magnesium content of between 4.0 and 4.6% by weight, the manganese content is advantageously between 0.45 and 0.60% by weight. In the second embodiment having a magnesium content of between 4.7 and 5.2% by weight, the manganese content is advantageously between 0.70 and 0.90% by weight.

Zinc, in the presence of manganese, improves the ultimate tensile strength but, beyond 0.40% by weight, the applicant has observed difficulties relating to the shaping of products and/or the corrosion resistance after welding. The presence of at least 0.15% by weight makes it possible simultaneously to improve the corrosion properties and the mechanical strength. Advantageously, the Zn content is between 0.15 and 0.35% by weight and preferably between 0.18 and 0.30% by weight.

Titanium, chromium, copper and zirconium also have a favorable effect on the yield point, and at least one element is selected from Ti, Cr, Cu and Zr, with a content, if it is selected, of 0.01-0.15 for Ti, 0.05-0.25 for Cr, 0.02-0.25 for Cu and 0.05-0.25 for Zr, as a percentage by weight. In an advantageous embodiment the elements added are titanium, chromium and copper, the zirconium content being less than 0.05% by weight and preferably less than 0.03% by weight.

Advantageously, the copper content is at least 0.05% by weight and preferably at least 0.06% by weight. In one embodiment of the invention the copper content is no more than 0.15% by weight and preferably 0.10% by weight. Advantageously, the chromium content is less than 0.1% by weight and preferably less than 0.09% by weight.

The iron content does not have a great deal of influence in the context of the present invention, it should be less than 0.40% by weight and preferably less than 0.35% by weight in order to avoid the formation of primary phases during casting.

The silicon content is less than 0.40% by weight. In one embodiment of the invention, a minimum content of 0.05% by weight in order to ensure the formation of silicon phases such as Mg2Si is preferred. Advantageously, the maximum silicon content is 0.15% by weight.

The applicant has not been able to find an appreciable influence of the other elements or impurities limited to 0.05% by weight per element, the sum thereof not exceeding 0.15% by weight.

After preparation of the alloy, a slab is cast by vertical semicontinuous casting. The slab is next optionally homogenized.

When a homogenization is performed, the temperature selected is between 535° C. and 550° C. for a duration of at least 12 hours. However, the present inventors have found that, surprisingly, excellent results are obtained in the absence of homogenization. In one embodiment the homogenization step is not performed but a simple reheating before hot rolling is performed at a temperature of between 490° and 535° C., preferentially between 495° and 525° C. and preferably between 500° and 520° C.

After homogenization and/or reheating, said slab is hot rolled in two successive steps in order to obtain a sheet with a first hot rolling step on a reversible mill to a thickness of between 12 and 35 mm and a second hot rolling step on a tandem mill to a thickness of between 3 and 12 mm. In the second hot rolling step, the final temperature must be at least 240° C. and less than 300° C. A tandem mill is a mill in which a plurality of stands supporting mill cylinders, typically 3, 4 or 5, act successively (in tandem). Typically the sheets obtained are coiled at the exit from the tandem mill. The entry temperature during the first rolling step is advantageously between 470° C. and 525° C., preferably between 480° C. and 515° C. and preferably between 490° C. and 505° C. The first step on the reversible mill can be performed on one or even two reversible mills placed successively. The entry temperature for the second hot rolling step is preferably between 350° C. and 450° C. The final temperature of the second hot rolling step must be less than 300°. The present inventors have in fact found that, if this temperature is too high, the corrosion resistance properties are insufficient. Advantageously, the final temperature during the second hot rolling step is between 240° C. and 280° C. During the second hot rolling step it is moreover advantageous for the reduction in thickness Re performed at a temperature of between 240° C. and 380° C. to be sufficient. This criterion can be determined directly if there are thicknesses e1 and e2 for which the sheet was, respectively, at a temperature of 380° C. and 240° C. during the rolling, and then Re=(e1−e2)/e1. If the entry temperature was less than 380° C. and/or the exit temperature was greater than 240° C., Re is the reduction in thickness between the effective entry temperature and/or exit temperature, respectively. Preferably, in the second hot rolling step, the final temperature is at least 250° C. or more preferentially 260° C. When the thicknesses e1 and e2 are not available, they can be estimated from the entry and exit temperatures and entry and exit thicknesses, respectively T_entry, T_exit, Ep_entry and Ep_exit during the second hot rolling step by linear extrapolation.

The present inventors have found that the properties are advantageous when a reduction in thickness Re of at least 30% is performed at a temperature of between 240° C. and 380° C. In the first embodiment having a magnesium content of between 4.0 and 4.6%, the present inventors have found that a reduction in thickness Re of at least 65% performed at a temperature of between 240° C. and 380° C. during the second hot rolling step is particularly advantageous, this advantageous reduction in thickness making it possible in particular to improve the granular thickness and the corrosion resistance after long-term exposure.

After hot rolling, it is possible optionally to cold roll the sheet obtained to a thickness of between 1 and 7 mm and preferably between 2 and 4 mm (MPa).

A final heat treatment of the hot-rolled sheet and optionally cold rolled at a temperature below 300° C. can finally optionally be performed. Typically, the final heat treatment is performed at a temperature of between 180° and 280° C., preferably between 190° and 220° C., for a period of typically between 1 h and 10 h. This type of treatment can in certain cases improve the corrosion resistance properties. However, by virtue of the method according to the invention, the final heat treatment is not essential and, in an advantageous embodiment, the final heat treatment step is not performed and the sheet is used in the as-manufactured temper, that is to say, according to circumstances, as hot rolled or as cold rolled.

The aluminum alloy sheets able to be obtained by the method according to the invention are advantageous since, after exposure of 7 days at 100° C., they exhibit a weight loss of less than 15 mg/cm$^2$ during a corrosion test in accordance with ASTM G67.

The granular structure of the samples was characterized by scanning electron microscopy (EBSD) using misorientation analysis in the granular regions by the KAM (Kernel Average Misorientation) method described for example in the article "A review of strain analysis using electron backscatter diffraction". Stuart I. Wright and al. Microsc. Microanal. 17, 316-329, 2011.

The local misorientation mapping of each sample is obtained by the kernel method. For a given pixel the mean of misorientations between this pixel and all its first neighbors (hexagonal pixels) belonging to the same grain is calculated, as illustrated in FIG. 1. In the context of this measurement, a grain is defined by a misorientation of 5° and a minimum size of 20 μm, for a measurement step of 0.15 μm. The local mean misorientation value is assigned to the central point. FIG. 1A illustrates the case wherein all the first neighbors, pixels 1 to 6, of the central pixel A form part of the same grain. The mean of the misorientations $\Delta g_K$ for pixel A is then obtained by the mean of the misorientations $\Delta g_{Ai}$ with respect to pixels 1 to 6. FIG. 1B illustrates the case wherein some of the first neighbors, pixels 5 and 6, of the central pixel A belong to a grain different from that of the central pixel. The mean of the misorientations for the pixel A is then obtained by the mean of the misorientations with respect to pixels 1 to 4.

In the context of the present invention, the KAM mean misorientation degree or KAM measurement is defined as the mean value of the misorientations for each pixel in the mapping. The conditions for acquisition and processing of EBSD data are given below, the electron microscope was a Zeiss ULTRAS microscope used with the following parameters: HT=20 kV, tilt=70°, WD=12 mm, surface area of the mapping: 250 μm (L)×200 μm (ST), pitch=0.15 μm. For processing the data the EDAX OIM v7.3.0 software was used, parameterized with the following conditions: (Cleaning and partitioning: Grain tolerance angle=5°, minimum grain size=20, minimum, CI: 0.1; multiple rows KAM analysis conditions: 1$^{st}$ nearest neighbor; maximum misorientation=5°).

In the first embodiment having a magnesium content of between 4.0 and 4.6%, the present inventors found that advantageously the KAM mean misorientation degree is at least 0.75. The use of a sheet according to the invention in naval construction or for constructing industrial vehicles is advantageous.

EXAMPLE

In this example, a plurality of slabs the composition of which is given in table 1 were cast.

TABLE 1

| Composition of slabs as % by weight | | | | | | | | |
|---|---|---|---|---|---|---|---|---|
| | Si | Fe | Cu | Mn | Mg | Cr | Zn | Ti |
| A | 0.10 | 0.27 | 0.05 | 0.51 | 4.3 | 0.08 | 0.24 | 0.01 |
| B | 0.11 | 0.26 | 0.06 | 0.56 | 4.4 | 0.07 | 0.22 | 0.02 |
| C | 0.10 | 0.29 | 0.04 | 0.54 | 4.4 | 0.09 | 0.22 | 0.02 |
| D | 0.03 | 0.14 | <0.01 | 0.79 | 4.8 | 0.08 | 0.01 | 0.03 |
| E | 0.05 | 0.16 | 0.06 | 0.83 | 4.7 | 0.02 | 0.19 | 0.02 |

The slabs were reheated to 520° C. then hot rolled in two successive steps in order to obtain a sheet.

In a first step, the hot rolling was performed on a reversible mill to a thickness of between 26 and 29 mm for alloys A to C and 15 to 17 mm for alloys D and E with an entry temperature on the reversible of between 490° C. and 510° C. In a second step, the hot rolling was performed on a tandem mill to a thickness of between 4 and 7 mm, the thickness at which the sheets were coiled, the rolling conditions in the tandem mill are given in table 2. For examples C #3 and C #4 a heat treatment at 340° C. was carried out after hot rolling in order to simulate the effect of an exit temperature of the tandem of 340° C. For example C #4 a treatment of 2 h at 210° C. was carried out after cold rolling.

TABLE 2

| Rolling conditions | | | | | | | |
|---|---|---|---|---|---|---|---|
| | Tandem rolling | | | | | | Cold rolling |
| | T_entry (° C.) | Ep_entry (mm) | T_exit (° C.) | Ep_exit (mm) | Re % reduction between 240 and 380° C.* | Annealing | Final thickness (mm) |
| A#1 | 416° C. | 26 mm | 269° C. | 6.3 mm | 70% | | |
| C#1 | 383° C. | 29 mm | 270° C. | 4.1 mm | 86% | | 3.7 mm |
| C#2 | 383° C. | 29 mm | 270° C. | 4.1 mm | 86% | | 3.4 mm |
| B#1 | 470° C. | 28 mm | 340° C. | 7.0 mm | 44% | | 6.3 mm |
| C#3 | 383° C. | 29 mm | 270° C. | 4.1 mm | | 340° C. | 3.7 mm |
| C#4 | 383° C. | 29 mm | 270° C. | 4.1 mm | | 340° C. | 3.7 mm |
| D#1 | 356° C. | 15 mm | 264° C. | 5.9 mm | 61% | | |
| E#1 | 415° C. | 17 mm | 265° C. | 9.5 mm | 38% | | |

*calculated by linear extrapolation

The mechanical properties obtained are given in table 3

TABLE 3

| Mechanical properties obtained | | | | |
|---|---|---|---|---|
| | | Mechanical properties of the product | | |
| | Thickness | $Rp_{0.2}$ (MPa) | Rm (MPa) | A % |
| A#1 | 6.3 mm | 232 | 333 | 15 |
| C#1 | 3.7 mm | 291 | 356 | 10 |
| C#2 | 3.4 mm | 328 | 375 | 6 |
| B#1 | 6.3 mm | 254 | 317 | 16 |
| C#3 | 3.7 mm | 248 | 321 | 14 |
| D#1 | 5.9 mm | 357 | 234 | 22 |
| E#1 | 9.5 mm | 348 | 242 | 16 |

The samples were subjected to a corrosion test in accordance with ASTM G67 "Standard Test Method for Determining the Susceptibility to Intergranular Corrosion of 5XXX Series Aluminum Alloys by Mass Loss After Exposure to Nitric Acid (NAMLT Test)". The results are given in the as-manufactured temper or after exposure of 7 days to 100° C.

The granular structure of the samples were moreover characterized by scanning electron microscopy (EBSD) as described previously in order to obtain the KAM value.

The results are given in table 4.

TABLE 4

Results of the corrosion tests and characterization of the grain misorientations by the KAM method.

| | | Results | | |
|---|---|---|---|---|
| | Thickness | NAMLT - as manufactured ($mg/cm^2$) | NAMLT after exposure of 7 days to 100° C. ($mg/cm^2$) | KAM |
| A#1 | 6.3 mm | 3.0 | 5.0 | 0.97 |
| C#1 | 3.7 mm | 5.2 | 14.6 | 0.78 |
| C#2 | 3.4 mm | 4.0 | 13.4 | 1.14 |
| B#1 | 6.3 mm | 5.0 | 21.0 | 0.69 |
| C#3 | 3.7 mm | 4.5 | 31.9 | 0.58 |
| C#4 | 3.7 mm | 20.7 | 24.5 | 0.57 |
| D#1 | 5.9 mm | | 27.9 | 0.51 |
| E#1 | 9.5 mm | 2.2 | 5.0 | 0.68 |

The products obtained with the method according to the invention (A #1, C #1, C #2 and E #1) show a result after such NAMLT H128 tests of less than 15 $mg/cm^2$. The products according to the invention the magnesium content of which is less than or equal to 4.6% by weight have a KAM mean misorientation degree of at least 0.75, as illustrated in FIG. 2.

The invention claimed is:

1. A method for manufacturing an aluminum alloy sheet, comprising a) preparing an aluminum alloy, with the composition, as % by weight
- Mg: 4.0-5.2,
- Mn: 0.40-1.0,
- Zn: 0.15-0.40,
- at least one element selected from Ti, Cr, Cu and Zr, with a content, if it is selected, of 0.01-0.15 for Ti, 0.05-0.25 for Cr, 0.02-0.25 for Cu, 0.05-0.25 for Zr,
- Fe: <0.40,
- Si: <0.40,
- other elements or impurities <0.05 each and <0.15 in total, the remainder aluminum,
- b) casting a slab by vertical semicontinuous casting,
- c) optionally, homogenizing said slab,
- d) hot rolling said optionally homogenized slab, in two successions, in order to obtain a sheet
  - dl) hot-rolling on a reversible mill to a thickness of between 12 and 35 mm,
  - d2) hot-rolling on a tandem mill to a thickness of between 3 and 12 mm, wherein the final temperature is at least 240° C. and is less than 300° C.,
- e) optionally, cold rolling said sheet, to a thickness of between 1 and 7 mm,
- f) optionally, carrying out a final heat treatment of said optionally cold-rolled sheet at a temperature below 300° C.

2. Method according to claim 1, wherein the Zn content is between 0.15 and 0.35% by weight and optionally between 0.18 and 0.30% by weight.

3. Method according to claim 1, wherein the homogenization c is not performed but a simple reheating is carried out before hot rolling at a temperature of between 490° and 535° C.

4. Method according to claim 1, wherein the final heat treatment f is not performed and wherein the sheet is used in the as-manufactured temper.

5. Method according to claim 1, wherein the final temperature during d2 is between 240° C. and 280° C.

6. Method according to claim 1, wherein a reduction in thickness of at least 30% is performed at a temperature of between 240° C. and 380° C. during d2.

7. An aluminum alloy sheet with a thickness of between 1 and 12 mm with a composition, as % by weight,
- Mg: 4.0-5.2,
- Mn: 0.40-1.0,
- Zn: 0.15-0.40,
- at least one element selected from Ti, Cr, Cu and Zr, with a content, if it is selected, of 0.01-0.15 for Ti, 0.05-0.25 for Cr, 0.02-0.25 for Cu, 0.05-0.25 for Zr,
- Fe: <0.40,
- Si: <0.40,
- other elements or impurities <0.05 each and <0.15 in total, the remainder aluminum,
- able to be obtained by the method according to claim 1 having, after exposure of 7 days at 100° C., a weight loss of less than 15 $mg/cm^2$ during a corrosion test in accordance with ASTM G67.
- Mn: 0.40-1.0,
- Zn: 0.15-0.40,
- at least one element selected from Ti, Cr, Cu and Zr, with a content, if it is selected, of 0.01-0.15 for Ti, 0.05-0.25 for Cr, 0.02-0.25 for Cu, 0.05-0.25 for Zr,
- Fe: <0.40,
- Si: <0.40,
- other elements or impurities <0.05 each and <0.15 in total, the remainder aluminum,
- b) casting a slab by vertical semicontinuous casting,
- c) optionally, homogenizing said slab,
- d) hot rolling said optionally homogenized slab, in two successions, in order to obtain a sheet
  - d1) hot-rolling on a reversible mill to a thickness of between 12 and 35 mm,
  - d2) hot-rolling on a tandem mill to a thickness of between 3 and 12 mm, wherein the final temperature is at least 240° C. and is less than 300° C.,
- e) optionally, cold rolling said sheet, to a thickness of between 1 and 7 mm,
- f) optionally, carrying out a final heat treatment of said optionally cold-rolled sheet at a temperature below 300° C.

8. Sheet according to claim 7, wherein the Mg content is between 4.0 and 4.6% by weight.

9. Aluminum alloy sheet according to claim 8, wherein the degree of KAM mean misorientation is at least 0.75.

10. A product comprising a sheet according to claim 7 for use in naval construction or for constructing an industrial vehicle.

11. The aluminum alloy sheet according to claim 7, wherein the Mn content is between 0.45 and 0.9% by weight.

12. The aluminum alloy sheet according to claim 7, wherein the Zn content is between 0.15 and 0.35% by weight.

13. The aluminum alloy sheet according to claim 7, wherein the Cu content is between 0.05 and 0.15% by weight.

14. The aluminum alloy sheet according to claim 7, wherein the Cr content is less than 0.1% by weight.

15. The aluminum alloy sheet according to claim 7, wherein the Fe content is less than 0.35% by weight.

16. The aluminum alloy sheet according to claim 7, wherein the Si content is between 0.05 and 0.15% by weight.

17. The aluminum alloy sheet according to claim 7, wherein the Mg content is between 4.0 and 4.6% by weight, and the Mn content is between 0.45 and 0.6% by weight.

18. The aluminum alloy sheet according to claim 7, wherein the Mg content is between 4.7 and 5.2% by weight, and the Mn content is between 0.7 and 0.9% by weight.

19. The aluminum alloy sheet according to claim 7, wherein the aluminum alloy sheet is cold rolled to a thickness of between 1 and 7 mm.

20. The aluminum alloy sheet according to claim 19, wherein the aluminum alloy sheet has a thickness of between 2 and 4 mm.

* * * * *